US007089605B2

(12) United States Patent
Jiang

(10) Patent No.: US 7,089,605 B2
(45) Date of Patent: Aug. 15, 2006

(54) TELESCOPING PLUNGER

(75) Inventor: Wei-Xin Jiang, ShenZhen (CN)

(73) Assignee: Waxman Consumer Products Group, Inc., Bedford Heights, OH (US)

( * ) Notice: Subject to any disclaimer, the term of this patent is extended or adjusted under 35 U.S.C. 154(b) by 41 days.

(21) Appl. No.: 10/775,303

(22) Filed: Feb. 10, 2004

(65) Prior Publication Data

US 2005/0172385 A1 Aug. 11, 2005

(51) Int. Cl.
*E03D 11/00* (2006.01)

(52) U.S. Cl. ..... 4/255.11; 16/429

(58) Field of Classification Search ..... 4/255.01, 4/255.11; 16/429

See application file for complete search history.

(56) References Cited

U.S. PATENT DOCUMENTS

| | | | | | |
|---|---|---|---|---|---|
| 1,406,841 | A | * | 2/1922 | Foss | 16/429 X |
| 2,279,324 | A | * | 4/1942 | Julien | 16/429 X |
| 2,334,057 | A | * | 11/1943 | Ashton et al. | 16/429 X |
| 2,697,842 | A | * | 12/1954 | Meyer | 4/255.11 X |
| 3,130,421 | A | | 4/1964 | Quinlan | 4/255.11 |
| 3,644,943 | A | | 2/1972 | Parodi fu Leonardo et al. | 4/255.11 |
| 4,745,641 | A | | 5/1988 | Tash | 4/255.11 |
| 5,114,006 | A | | 5/1992 | Wilk | 4/255.11 X |
| 5,305,882 | A | | 4/1994 | Kaplan et al. | 4/255.09 X |
| 5,335,374 | A | | 8/1994 | Wilk et al. | 4/255.11 |
| 5,456,356 | A | | 10/1995 | Kurzawa | 4/255.11 X |
| 6,055,680 | A | | 5/2000 | Tolbert | 4/255.11 |

* cited by examiner

*Primary Examiner*—Robert M. Fetsuga
(74) *Attorney, Agent, or Firm*—Watts Hoffmann Co, LPA

(57) ABSTRACT

A toilet plunger assembly having telescopic features is disclosed. The plunger assembly includes a cup assembly, a tubular member and an elongated rod. The tubular member has a first end portion and a second end portion. The second end portion is fixed to the cup assembly. The elongated rod has a first end portion, a second end portion, and an outer diameter. The rod is slideably engaged within the tubular member such that the rod is moveable between a collapsed position and an extended position. In the collapsed position, the rod second end portion is removably joined to the cup assembly, while in the extended position, the rod second end portion is removably joined to the tubular member first end portion.

5 Claims, 3 Drawing Sheets

TELESCOPING PLUNGER

FIELD OF THE INVENTION

The present invention relates to a toilet plunger and more particularly to a toilet plunger having telescopic features allowing for storage in confined areas.

BACKGROUND OF THE INVENTION

Toilet plungers are well known and widely used in bathrooms of residences, office buildings, retail establishments and restaurants. Most conventional plungers include a plunger cup mounted to a fixed length handle. It is further known and appreciated that the conventional use of a plunger is to unclog the exit piping leading from a toilet to a sewer system or other types of collection system. This use inherently creates both sanitary and aesthetic issues for any party responsible for bathroom maintenance.

It is common to store a plunger on the floor adjacent to a toilet in a conveniently locatable site. However, a plunger is unsightly and may contrast to the decorum of certain bathrooms. As a result, some plungers are stored in closets or in other enclosed areas. However, the length of a typical plunger handle prohibits storage of a plunger in many areas. Further, the conventional size of a plunger makes its presence in most bathrooms quite apparent, i.e., it is difficult to hide in a corner, for example.

In light of the prior art problems discussed, it would be desirable to have a toilet plunger that features a telescopic handle. Further, it would be advantageous to have a telescopic plunger that is operational without a user having to touch the toilet plunger cup.

The present invention provides a new and improved toilet plunger having a telescopic handle. The present invention uses a two part handle design wherein the device is transferable between an extended position and a collapsed position by manipulation of the handle.

SUMMARY OF THE INVENTION

In an illustrated embodiment of the invention, a toilet plunger featuring a telescopic handle is disclosed. It should be understood that the illustration of a plunger in the accompanying drawings includes a conventional cup for exemplary purposes only and the invention may be practiced with the use of toilet plungers having new, improved or otherwise alternative cup designs.

A toilet plunger assembly of the present invention includes a cup assembly, a tubular member, and a elongated rod. The tubular member has a first end portion and a second end portion, wherein the second end portion is fixed to the cup assembly. The elongated rod has a first end portion, a second end portion, and an outer diameter. The rod is slideably engaged within the tubular member such that the rod is moveable between a collapsed position and an extended position. Further, the rod second end portion is removably joined to the cup assembly when the rod is in the collapsed position. Alternatively, the rod second end portion is removably joined to the tubular member first end portion when the rod is in the extended position.

The tubular member second portion may include a threaded section disposed on an exterior surface of the tubular member. As such, the cup assembly may include an inverted suction cup having threads adapted to engage the threads of the tubular member second portion.

The tubular member first portion may include a threaded section disposed on an interior surface of the tubular member. As such, the rod second portion may include a threaded section adapted to engage the threads of the tubular member first portion.

The rod second end portion may include a stem extending axially from the rod and having a outer diameter less than the rod outer diameter, wherein the stem includes a threaded section disposed on an exterior surface of the stem. As such, the cup assembly may include an inverted suction cup and a connector adapted to engage the rod second end portion.

Further features and advantages of the invention will become apparent from the following detailed description made with reference to the accompanying drawings.

DETAILED DESCRIPTION OF THE INVENTION

Figure 1:
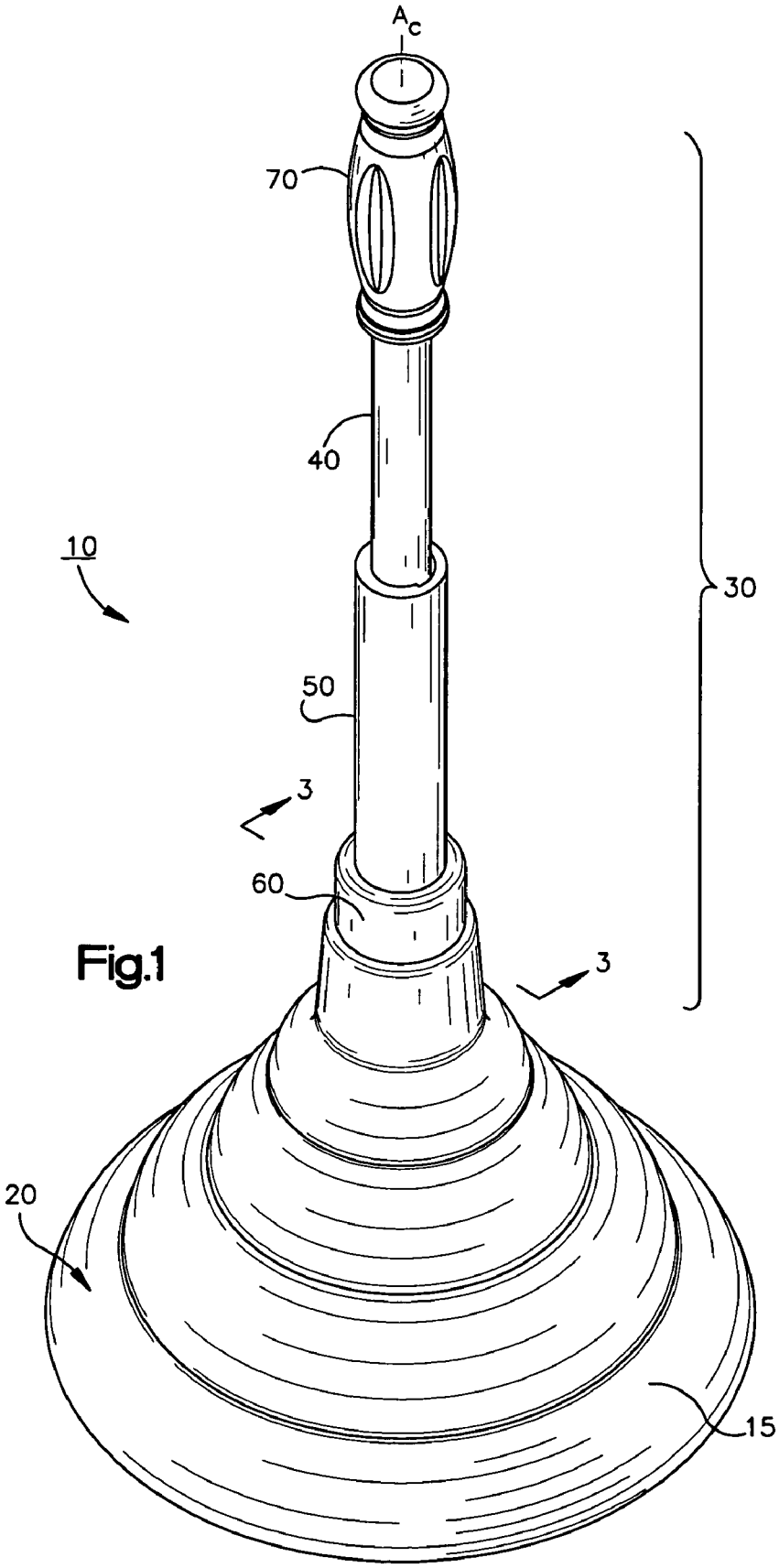
FIG. 1 is a perspective view of a telescoping plunger assembly constructed in accordance with one embodiment of the present invention.

Referring now to the drawings, a plunger assembly 10 constructed in accordance with one embodiment of the present invention is illustrated. The plunger assembly 10 has telescopic features allowing for storage in confined areas. The plunger assembly as shown includes a conventional inverted suction cup 15. It should be understood that the illustration of an inverted suction cup is for exemplary purposes only and the invention may be practiced with the use of various suction apparatus.

Figure 2:
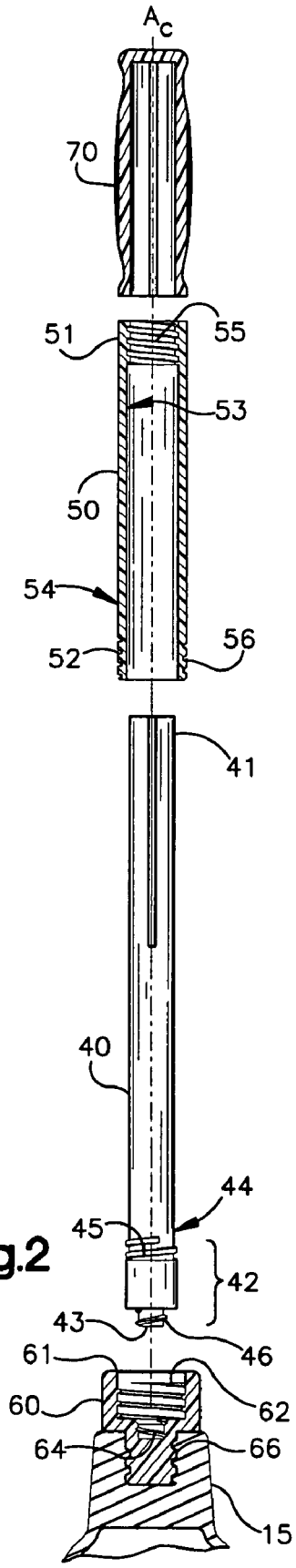
FIG. 2 is an exploded cross sectional view of several parts of the plunger shown in FIG. 1.
Figure 3:
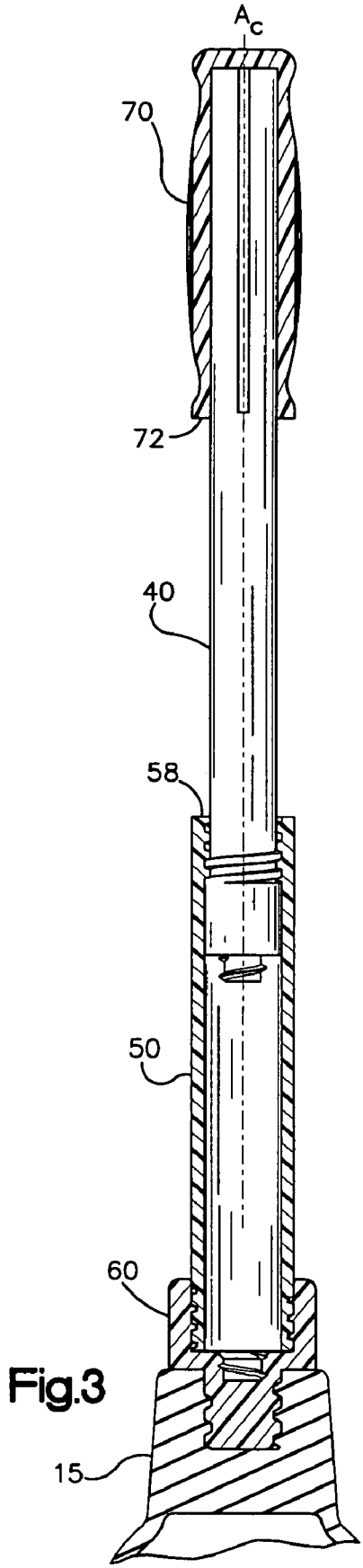
FIG. 3 is a cross-sectional view of the plunger shown in FIG. 1 as seen approximately from a plane taken along the lines 3—3 of FIG. 1, showing the plunger handle in an extended position.
Figure 4:
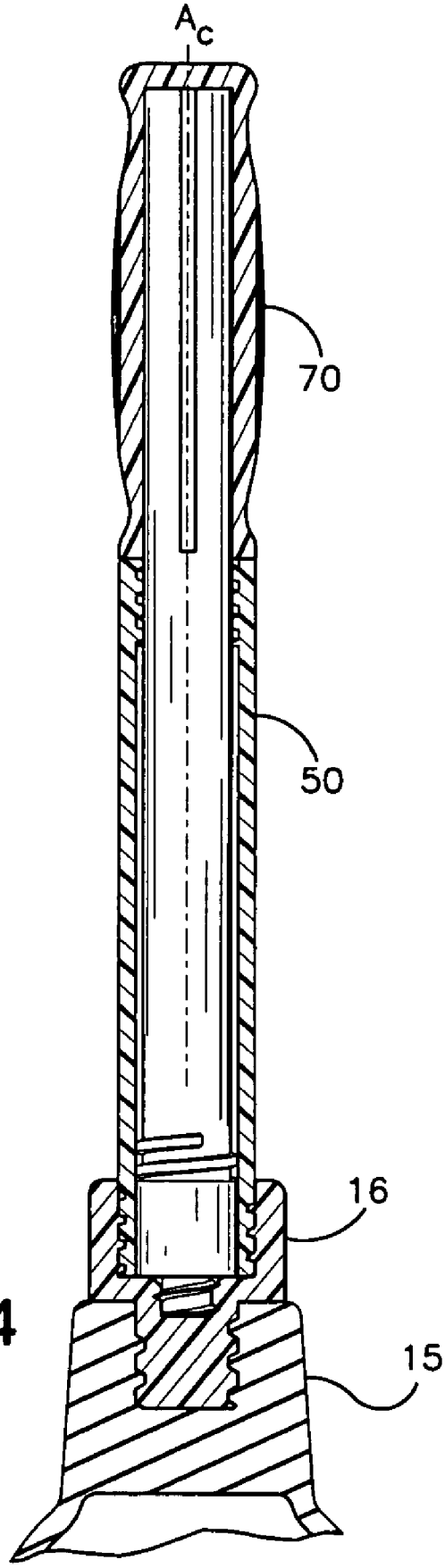
FIG. 4 is a cross-sectional view of the plunger of FIG. 1, showing the plunger handle in a collapsed position.

Referring now to FIG. 1, a telescoping plunger assembly 10 is illustrated. The plunger assembly includes a handle assembly 30 mounted to the inverted suction cup 15. As shown in FIG. 2, the handle assembly 30 includes an elongated solid rod 40, a hollow tubular member 50, and a grippable handle 70. The components of the plunger 10 are cooperatively mounted along a center axis $A_c$ as best shown in FIGS. 2–4.

As shown in FIG. 1, the suction cup 15 includes a top surface 20. The top surface includes mating means allowing for engagement to a plunger connector 60. The mating of the plunger connector to the top surface 20 of the suction cup 15 is best shown in FIG. 2. It should be understood by those with ordinary skill in the art, that the present invention can be practiced without the use of a separate plunger connector 60, i.e., the plunger cup 15 itself may include mating means. It should also be understood by those with ordinary skill in the art that the tubular member 50, the plunger connector 60, and the inverted plunger cup 15 may be uniformly made as one piece in the practice of the present invention.

Referring now to FIG. 2, an exploded cross sectional view of several parts of the plunger assembly 10 are shown. As discussed, the plunger assembly 10 includes an elongated solid rod 40 having a first end portion 41 and a second end portion 42. As shown in FIG. 2, an extended stem 43 protrudes axially from the second end portion 42. The second end portion 42 further includes several threaded connections on an external surface 44 of the second end portion 42. With respect to the first end portion 41, a proximal threaded section 45 and a distal threaded section 46, or stem threaded section, are disposed on the exterior surface 44. As can be appreciated by viewing FIGS. 3–4, the elongated rod 40 has a limited outer diameter allowing for insertion through the hollow tubular member 50.

As shown in the Figures, the handle 70 is fixedly mounted to the first end portion 41 of the rod 40 by adhesive or other suitable method. It should also be understood by those with ordinary skill in the art that the rod 40 and the handle 70 may be uniformly made as one piece in the practice of the present invention.

The tubular member 50 also includes a first end portion 51 and a second end portion 52. An internal surface 53 defines an inner diameter and as external surface 54 defines an outer diameter. The tubular member includes a female threaded connection 55 at the first end portion and a male threaded connection 56 at the second end portion.

Still referring to FIG. 2, the plunger connector 60 is shown in detail. An inner circular-shaped opening 61 is disposed distal to the elongated rod 40 with respect to the suction cup 15. Disposed in the inner opening 61 is a first inner threaded section 62 and a second inner threaded section 64. An external threaded connection 66 mates with threads disposed in the inverted plunger suction cup 15 as shown.

Referring now to FIGS. 3 and 4, two cross sectional views of the plunger shown in FIG. 1 as seen approximately along a plane taken along the lines 3—3 are shown. In FIG. 3, the plunger is shown in an extended position and in FIG. 4 the plunger is shown in a collapsed position. In between these two positions, the elongated rod 40 is engaged and slideable within the tubular member 50. In operation of the plunger assembly, rotation of the grippable handle 70 is used to first, lock the assembly in either the extended or collapsed position, and second, unlock the assembly from either the collapsible or extendable position. It should be understood by others with ordinary skill in the art that modifications that incorporate either clockwise or counterclockwise rotation for locking or unlocking means may be used in the practice of the present invention.

Referring specifically now to FIG. 3, the handle assembly 30 is shown locked in an extended position. As such, the proximal threaded section 45 of the elongated rod 40 is shown engaged with the female threaded section 55 of the first end portion 51 of the tubular member 50. The present invention allows for the connection made to be of sufficient strength and stability to allow for conventional use of the plunger to unclog a toilet. In other words, axial pressure caused by a user's manipulation of the grippable handle 70 will not cause the connection made between the second end portion of the elongated rod 40 and the first end portion of the tubular member 50 to become disengaged.

Referring now specifically to FIG. 4, the handle assembly 30 is shown in a collapsed position. As such, the distal or stem threads 46 of the second end portion 42 of the elongated rod 40 are shown engaged with the second inner threaded section 64 of the plunger connector 60. While in a collapsed position, a user may transport the plunger assembly 10 by gripping on the handle 70. The connection made between the elongated rod 40 and the plunger connector 50 is sufficient to allow for transportation without the rod becoming disengaged.

Referring again to FIG. 3, an abutment face 58 of the tubular member and a handle abutment face 72 of the handle 70 are shown. These two faces 58, 72 are shown engaged in FIG. 3 in a collapsible position. This feature provides guidance to a user to determine when sufficient locking has occurred to achieve the collapsed position.

While a single embodiment of the invention has been illustrated and described in considerable detail, the present invention is not to be considered limited to the precise construction disclosed. Various adaptations, modifications and uses of the invention may occur to those with ordinary skill of the art to which the invention relates. It is the intention of the applicant to cover all such adaptations, modifications and uses falling within the scope and spirit of the claims filed herewith.

What is claimed is:

1. A toilet plunger assembly comprising:

a) an inverted suction cup;

b) a connector having a first end and a second end, said second end having an inner opening with first and second threaded sections disposed on an interior surface thereof;

c) a tubular member comprising a first end, a second end, an interior surface and an exterior surface, said first end having a threaded section disposed on said interior surface thereof and said second end having threaded section disposed on said exterior surface thereof, said second end threaded section adapted to engage the first threaded section of said connector second end; and d) an elongated rod comprising a first end, a second end, an outer diameter, and an exterior surface, said second end having distal and proximal threaded sections disposed on an exterior surface thereof, said distal threaded section adapted to engage the second threaded section of said connector second end, and said proximal threaded section adapted to engage the threads of said tubular member first end;

e) wherein said rod is slideably engaged within said tubular member from a collapsed position to an extended position.

2. The plunger assembly of claim 1 wherein the first threaded section of the connector second end is of a greater diameter than the second threaded section of said connector second end.

3. The plunger assembly of claim 1 wherein said rod second end comprises a stem portion extending axially from said rod having an outer diameter less then said rod outer diameter, the distal threaded section being disposed on the stem portion.

4. The plunger assembly of claim 1 wherein an axial rotation of said rod with respect to said cup disengages said rod from the cup when in said collapsed position.

5. The plunger assembly of claim 1 wherein an axial rotation of said rod with respect to said cup disengages said rod from the tubular member when in said extended position.

* * * * *